US009050603B2

(12) United States Patent
Assmann et al.

(10) Patent No.: US 9,050,603 B2
(45) Date of Patent: Jun. 9, 2015

(54) ROLLER MILL AND METHOD FOR OPERATING A ROLLER MILL

(75) Inventors: Björn Olaf Assmann, Hamm (DE); Werner Brosowski, Hamm (DE); Markus Berger, Ennigerloh (DE)

(73) Assignee: ThyssenKrupp Industrial Solutions AG (DE)

( * ) Notice: Subject to any disclaimer, the term of this patent is extended or adjusted under 35 U.S.C. 154(b) by 47 days.

(21) Appl. No.: 13/985,438

(22) PCT Filed: Feb. 7, 2012

(86) PCT No.: PCT/EP2012/052052

§ 371 (c)(1), (2), (4) Date: Aug. 14, 2013

(87) PCT Pub. No.: WO2012/110363

PCT Pub. Date: Aug. 23, 2012

(65) Prior Publication Data

US 2013/0320120 A1 Dec. 5, 2013

(30) Foreign Application Priority Data

Feb. 15, 2011 (DE) ..... 10 2011 000 748

(51) Int. Cl.

*B02C 23/00* (2006.01)
*B02C 4/42* (2006.01)
*B02C 25/00* (2006.01)

(52) U.S. Cl.

CPC .. *B02C 4/42* (2013.01); *B02C 25/00* (2013.01)

(58) Field of Classification Search

CPC ..... B02C 4/42; B02C 35/00; B02C 25/00
USPC ..... 241/35–36, 235, 22, 224, 30
See application file for complete search history.

(56) References Cited

U.S. PATENT DOCUMENTS 4,478,371 A 10/1984 Williams
4,640,464 A 2/1987 Musto et al.
5,429,312 A 7/1995 Ohno et al.

FOREIGN PATENT DOCUMENTS

EP 0514953 A2 11/1992

*Primary Examiner* — Faye Francis
(74) *Attorney, Agent, or Firm* — Renner Kenner Greive Bobak Taylor & Weber

(57) ABSTRACT

The roller mill according to the invention consists substantially of two grinding rollers which are driven in opposite directions and form between them a grinding gap for comminuting material to be ground, and a delivery chute via which the material to be ground is fed to the grinding gap. Furthermore, there is provided in the delivery chute a pressure sensor for measuring the static gas pressure, which pressure sensor is connected to a control or regulating device, which changes the circumferential speed of the grinding rollers in dependence on the measured static gas pressure. In the method according to the invention for operating the above roller mill, the static gas pressure in the delivery chute is measured and used to control or regulate the circumferential speed of the grinding rollers.

10 Claims, 1 Drawing Sheet

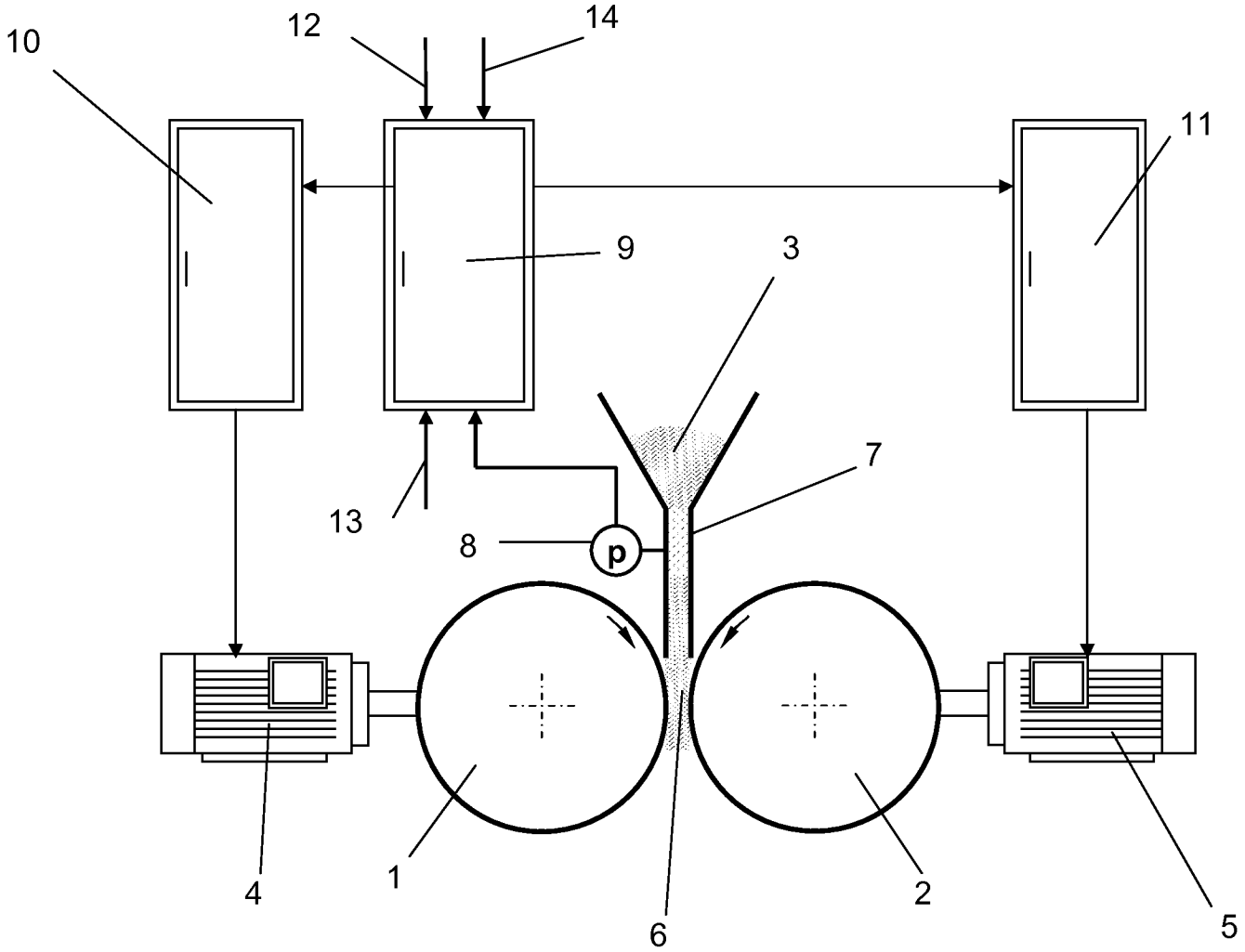
11
5
2
7
3
6
14
9
p
8
1
12
13
4
10

ROLLER MILL AND METHOD FOR OPERATING A ROLLER MILL

The invention relates to a roller mill and a method for operating a roller mill having two grinding rollers for comminuting material to be ground, wherein at least one grinding roller is driven and the grinding rollers form between them a grinding gap for comminuting the material to be ground, and a delivery chute via which the material to be ground is fed to the grinding gap.

The throughput of such roller mills, in particular of material bed roller mills, is dependent, for a given mill and given material to be ground, only on the circumferential speed of the grinding rollers. However, the maximum possible circumferential speed is limited by the properties of the material in the intake.

In the case of grinding in a material bed roller mill, grinding pressures of 50 MPa or more are used. The material to be ground is thereby taken in and comminuted in the material bed with the formation of so-called agglomerates or slugs, which may be deagglomerated in a subsequent working step. During grinding, the volume flow of air from the difference in density between the material in the intake and the slug must be dissipated. The volume flow of air introduced with the feed material is calculated from the feed mass flow and the difference between the density in the intake and the true density.

The volume flow of air is discharged from the compression zone. Owing to the small width of the compression zone and the large volume flow of air that is to be discharged, correspondingly high speeds occur in the delivery chute. Not only is the material to be ground thereby fluidised, but a swirling or even pulsating fluidised layer can occur as a result of the formation of air bubbles. The formation of air bubbles leads to separations in the material to be ground and to fluctuating throughputs with consequential vibrations.

From DE 44 04 638 there is known a roller mill having a plurality of grinding rollers which cooperate with a driven grinding table, the material to be ground being fed via a delivery chute. Deposits in the delivery chute, and hence a reduction in the cross-sectional area of the chute channel, can be detected by measuring a pressure difference in the delivery chute. In dependence on the measured pressure difference, hydraulic cylinders can be actuated, which effect the removal of any deposits.

There is further known from U.S. Pat. No. 4,640,464 A a roller mill in which grinding rollers roll on a grinding ring and the material to be ground is comminuted between the grinding roller and the grinding ring. The comminuted material to be ground is carried via an air stream into a sifter arranged above the grinding rollers. A control and regulating device monitors the rate of supply of the material to be ground in dependence on the amount of comminuted material to be ground that is discharged, the correct ratio of air to solid being ensured. The air stream is detected in particular by way of pressure sensors.

The object underlying the invention is, therefore, to develop the roller mill, or the method for operating the roller mill, further so that, on the one hand, as high a throughput as possible is ensured and, on the other hand, the formation of air bubbles, with the disadvantages described above, is largely avoided.

The object is achieved according to the invention by the features of claims 1 and 6.

The roller mill according to the invention consists substantially of two grinding rollers, which are driven in opposite directions and form between them a grinding gap for comminuting material to be ground, and a delivery chute via which the material to be ground is fed to the grinding gap. Furthermore, there is arranged in the delivery chute a pressure sensor for measuring the static gas pressure, which pressure sensor is connected to a control or regulating device, which changes the circumferential speed of the grinding rollers in dependence on the measured static gas pressure.

The pressure in flowing media is composed of a static component and a dynamic component, the static pressure being measured according to the invention.

In the method according to the invention for operating the above roller mill, the static gas pressure in the delivery chute is measured and used to control or regulate the circumferential speed of the grinding rollers.

During ventilation, the air flowing along the path from the compression zone to the free surface generates a pressure drop. The level of the pressure is dependent on the porosity of the material and on the distance to the free surface. In a given roller mill, the level of the pressure in the material flowing in is thus a measure of the porosity of the material and accordingly of the intake and ventilation conditions.

The maximum throughput of a roller mill is accordingly determined by the porosity and hence the flow resistance of the material. However, the porosity of the material in the intake region changes constantly in the case of real materials to be ground, on the one hand owing to differing particle size distributions of the feed material and on the other hand owing to changing grindabilities. Changes in porosity and hence in the flow resistance at the same time cause a change in the static pressure in the material flowing in.

In order to compensate for these unstable conditions, the rotational speed and accordingly the circumferential speed of the grinding rollers is adjusted according to the invention, there being used as the control and/or regulating variable the static gas pressure, which is kept constant by adjusting the rotational speed of the grinding rollers. This regulation allows the disruptive effects of changes in the porosity purposively to be corrected, and the roller mill can thus always be operated at the maximum throughput.

Further embodiments of the invention are the subject-matter of the dependent claims.

A drive device can be associated with at least one grinding roller, but preferably with both grinding rollers, which drive device is connected to the control or regulating device and preferably has a motor controlled by way of a frequency converter. Adjustment of the rotational speed of the grinding rollers can in particular take place by way of a frequency converter with field-oriented speed control.

The control or regulating device is preferably formed by a model-assisted control or regulating device, it being possible to use in particular a model-based predictive control or regulating device.

During operation, a desired gas pressure, which is dependent on the material to be ground and on the fineness that is to be achieved, is compared with the measured, static gas pressure, the rotational speed of the grinding rollers being reduced if the measured static gas pressure is greater than the desired gas pressure and the rotational speed of the grinding rollers being increased if the measured static gas pressure is less than the desired air pressure. The roller mill can be operated, for example, with a desired gas pressure of approximately from 5 to 200 mbar, preferably from 20 to 200 mbar, excess pressure.

Further advantages and embodiments of the invention will be explained in greater detail below by means of the following description of an exemplary embodiment and the drawing.

The drawing shows a schematic representation of a roller mill according to the invention.

The roller mill according to the invention has two grinding rollers 1, 2 for comminuting material to be ground 3, which is fed via a delivery chute 7 to a grinding gap 6 formed between the grinding rollers. The two grinding rollers 1, 2 are driven in opposite directions by associated drive devices 4, 5 and cooperate with a force application system in order to enable the grinding force to be adjusted.

Furthermore, there is arranged in the delivery chute 7 a pressure sensor 8 for measuring the static gas pressure, which pressure sensor 8 is connected to a control or regulating device 9, which changes the circumferential speed of the grinding rollers 1, 2 in dependence on the measured air pressure. To that end, the two drive devices 4, 5 are in the form of asynchronous motors, for example, which are controlled by way of associated frequency converters 10, 11. Adjustment of the circumferential speed of the grinding rollers 1, 2 by way of the frequency converters 10, 11 can take place with field-oriented speed control.

The control or regulating device 9 is preferably formed by a model-assisted control or regulating device, it being possible to use in particular a model-based predictive control or regulating device.

In the case of model-based predictive regulation, a prediction of the status development is calculated and evaluated in dependence on system parameters 12 and/or status or measured data 13 and/or external information 14 with the aid of a dynamic model of the process to be regulated, and the prediction is used to control the frequency converters 10, 11. The system parameters 12 are, for example, fixed values, such as the power of the drive devices or the grinding roller diameter. Throughput values or the rotational speed of the grinding rollers are used in particular as the status or measured data 13. The external information 14 is formed, for example, by the material to be comminuted, the desired fineness, or the grinding force generated by the grinding rollers 1, 2.

A desired value for the gas pressure in the delivery chute is calculated from all the input values with the aid of the model and is compared with the static gas pressure measured by the pressure sensor 8, the rotational speed of the grinding rollers being reduced if the measured static gas pressure is greater than the desired value and the rotational speed of the grinding rollers being increased if the measured static gas pressure is less than the desired value.

In the tests underlying the invention, a desired value for the gas pressure of approximately from 5 to 200 mbar, preferably from 20 to 200 mbar, excess pressure has been found to be particularly suitable on the one hand for achieving as high a throughput as possible and on the other hand for avoiding the formation of air bubbles in the delivery chute and the associated separation of the material to be ground and fluctuating throughputs with consequential vibrations.

The invention claimed is:

1. Roller mill having two grinding rollers which are driven in opposite directions and form between them a grinding gap for comminuting material to be ground, and a delivery chute via which the material to be ground is fed to the grinding gap, characterised by a pressure sensor arranged in the delivery chute for measuring the static gas pressure, and a control or regulating device which is connected to the pressure sensor and changes the circumferential speed of the grinding rollers in dependence on the measured gas pressure.

2. Roller mill according to claim 1, characterised in that a drive device is associated with at least one grinding roller, preferably with both grinding rollers, which drive device is connected to the control or regulating device.

3. Roller mill according to claim 1, characterised in that the control or regulating device is formed by a model-assisted control or regulating device.

4. Roller mill according to claim 1, characterised in that the control or regulating device is formed by a model-based predictive control or regulating device.

5. Roller mill according to claim 1, characterised in that the drive device has a motor controlled by way of a frequency converter.

6. A method for operating a roller mill comprising the steps of:

delivering material to be ground to a grinding gap between two grinding rollers via a delivery chute;

grinding the material at the grinding gap by driving the two grinding rollers in opposite directions;

measuring the static gas pressure in the delivery chute; and regulating the rotational speed of the grinding rollers based on the pressure in said step of measuring.

7. The method according to claim 6, further comprising establishing a desired value for the gas pressure in dependence on the material to be ground and the fineness that is to be achieved, and adjusting the rotational speed of the grinding rollers by reducing the rotational speed of the grinding rollers when the measured static gas pressure is greater than the desired value, and increasing the rotational speed of the grinding rollers when the measured static gas pressure is less than the desired value.

8. The method according to claim 6, characterised in that the desired gas pressure of said step of establishing a desired value for the gas pressure is from 5 to 200 mbar excess pressure.

9. The method according to claim 6, wherein said step of regulating the rotational speed of the grinding rollers takes place by means of a model-assisted regulation.

10. The method according to claim 7, characterised in that said step of adjusting the rotational speed of the grinding rollers takes place by way of frequency converters with field-oriented speed control.

* * * * *